US007663560B1

(12) United States Patent
Butterworth et al.

(10) Patent No.: US 7,663,560 B1
(45) Date of Patent: Feb. 16, 2010

(54) ANTENNA POINTING AID

(75) Inventors: James R. Butterworth, Rancho Palos Verdes, CA (US); Milton E. Studt, II, Seal Beach, CA (US); Joseph Santoru, Agoura Hills, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 631 days.

(21) Appl. No.: 11/274,771

(22) Filed: Nov. 15, 2005

(51) Int. Cl.
*H01Q 17/00* (2006.01)
*H01Q 3/00* (2006.01)

(52) U.S. Cl. ..... 343/703; 343/894; 342/359

(58) Field of Classification Search ..... 343/772, 343/786, 840, 872, 873, 703, 761; 342/359, 342/360

See application file for complete search history.

(56) References Cited

U.S. PATENT DOCUMENTS

| | | | | |
|---|---|---|---|---|
| 3,579,242 | A | | 5/1971 | Grantham |
| 3,864,687 | A | | 2/1975 | Walters et al. |
| 4,185,287 | A | * | 1/1980 | Hubing et al. ..... 343/761 |
| 4,225,869 | A | | 9/1980 | Lohrmann |
| 4,626,863 | A | | 12/1986 | Knop et al. |
| 4,888,596 | A | | 12/1989 | Conanan |
| 5,126,750 | A | | 6/1992 | Wang et al. |
| 5,317,328 | A | | 5/1994 | Allen |
| 5,907,310 | A | | 5/1999 | Seewig et al. |
| 5,936,584 | A | | 8/1999 | Lawrence et al. |
| 6,501,432 | B2 | | 12/2002 | Yuanzhu |
| 6,611,238 | B1 | | 8/2003 | Santoru et al. |
| 6,924,775 | B2 | | 8/2005 | Suga |
| 2003/0117332 | A1 | | 6/2003 | Hirota et al. |
| 2005/0001776 | A1 | | 1/2005 | Nagano |

OTHER PUBLICATIONS

US 6,703,986, 03/2004, Pryor et al. (withdrawn)

* cited by examiner

*Primary Examiner*—Michael C Wimer

(57) ABSTRACT

A satellite system 10 includes an outdoor unit that has an LNB 24. The antenna of the outdoor unit is aligned using a microwave energy-absorbing cap. The microwave-absorbing cap has microwave-absorbing material therein or thereon. A signal strength meter is used to measure the signal strength with the cap on so that the signal strength meter is less likely to be saturated during the alignment process.

4 Claims, 3 Drawing Sheets

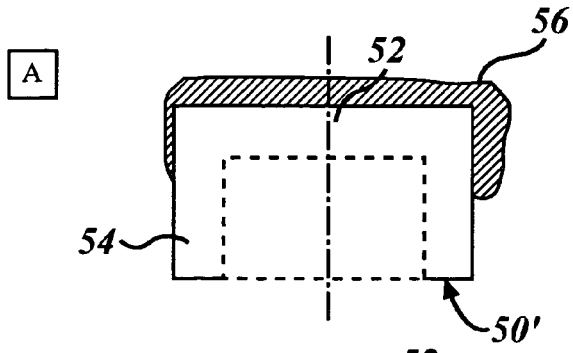
FIG. 5
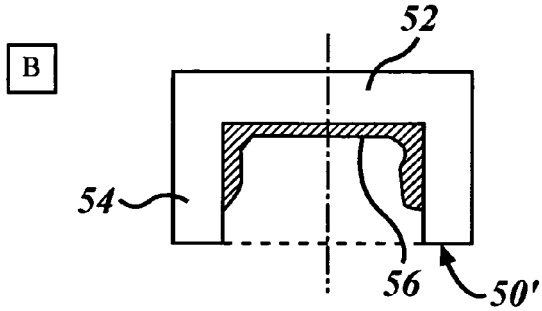
FIG.6
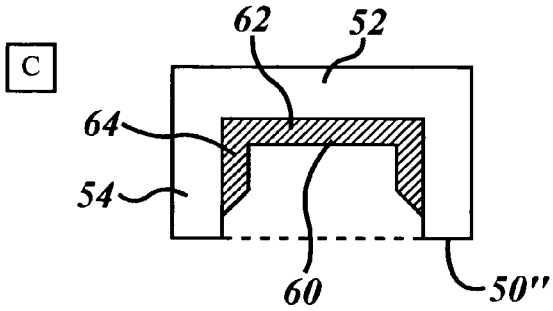
FIG.7
| Angular Position | Signal Meter Reading | Delta From Boresight | IRD Reading | Delta From Boresight |
|---|---|---|---|---|
| NO CAP | | | | |
| Boresight | 84.5 | | 86.5 | |
| 1 Degree Left | 84.1 | 0.4 | 86 | 0.5 |
| 1.5 Degree Left | 82.9 | 1.6 | 84.5 | 2 |
| 2 Degrees Left | 81.2 | 3.3 | 82.5 | 4 |
| 1 Dree Right | 83.1 | 1.4 | 85.5 | 1 |
| 1.5 Degree Right | 81.7 | 2.8 | 84 | 2.5 |
| 2 Degrees Right | 79.8 | 4.7 | 81 | 5.5 |
| WITH CAP | | | | |
| Boresight | 74.2 | | 47.5 | |
| 1 Degree Left | 73.5 | 0.7 | 44.5 | 3 |
| 1.5 Degree Left | 72.5 | 1.7 | 41.5 | 6 |
| 2 Degrees Left | 70.8 | 3.4 | 35.5 | 12 |
| 1 Dree Right | 72.8 | 1.4 | 44.5 | 3 |
| 1.5 Degree Right | 71.6 | 2.6 | 41.5 | 6 |
| 2 Degrees Right | 69.9 | 4.3 | 36.5 | 11 |
FIG.8

ANTENNA POINTING AID

TECHNICAL FIELD

The present invention relates to satellite earthstation antenna pointing, and more particularly, to a method of pointing an antenna toward a satellite.

BACKGROUND OF THE INVENTION

Satellite TV is becoming increasingly popular with consumers. Satellite TV requires an outdoor unit that has an antenna that must be precisely aligned to properly receive signals from the satellite. The integrated receiver/decoder or set-top box has a signal strength meter therein. The signal strength meter is used to measure the strength of the signal and therefore fine tuning of the alignment of the outdoor unit may be performed. The signal strength meter has a range of 0 to 100 that is proportional to the carrier-to-noise (C/N) signal measured by the demodulator/forward-error correction application specific integrated circuit in the IRD. Mapping of the output of the carrier-to-noise signal is not linear. The signal actually saturates at a value of 100 for a carrier-to-noise ratio of about 16 decibels. This is illustrated in FIG. 1. If the carrier-to-noise ratio is high, the installation technician may not know if the antenna is pointed in the optimal direction. The small difference of antenna pointing may drop the carrier-to-noise ratio by 1 to 2 decibels. However, if the signal strength is saturated, for example the carrier-to-noise ratio is 20 decibels, pointing changes could not be detected until the carrier-to-noise ratio drops well below 16 decibels. This means that the antenna will seem to be pointed properly when in fact it is pointed far from the optimal direction. Due to the antenna beam width and a high carrier-to-noise ratio the antenna may be mispointed in such conditions by 1 or 2 degrees, causing a degradation in the quality of services received. Therefore, it would be desirable to provide a method and apparatus for accurately pointing the antenna of an outdoor unit.

SUMMARY

The present invention provides a cap having a microwave material that fits over the input aperture of the low noise block mounted on a outdoor unit. The cap has microwave-absorbing material that does not distort the radiation pattern of the low noise block horn antenna.

In one aspect of the invention, the outdoor unit comprises a low noise block, an antenna directing a signal from a satellite into the low noise block along a path, and a removable cap disposed on the low noise block having a microwave-absorbing material coupled thereto. The microwave-absorbing material is disposed within the path.

In a further aspect of the invention, a method of aligning an outdoor unit comprises placing a microwave-absorbing cap on a low noise block, absorbing microwave energy with the cap, thereafter determining a signal strength and orienting the outdoor antenna in a direction corresponding to a maximum signal strength.

The present invention is particularly useful in areas that receive maximum power for a downlink spot beam. Also, the present invention may be used for various satellite frequency bands including Ku and Ka bands. Larger antennas typically used for multiple dwelling units are also more difficult to orient and thus using the cap and method according to the present invention will reduce pointing errors in multiple dwelling units.

BRIEF DESCRIPTION OF THE DRAWINGS

FIG. 5 is a cross-sectional view of a first embodiment of a cap with microwave absorbent material.

FIG. 6 is a second embodiment of a cap having microwave-absorbing material thereon.

FIG. 7 is a cross-sectional view of a third embodiment of the invention of a cap having a microwave-absorbing plug therein.

FIG. 8 is a chart illustrating signal meter reading measurements, boresight measurements, and IRD readings thereof.

DESCRIPTION OF THE PREFERRED EMBODIMENT(S)

Figure 1:
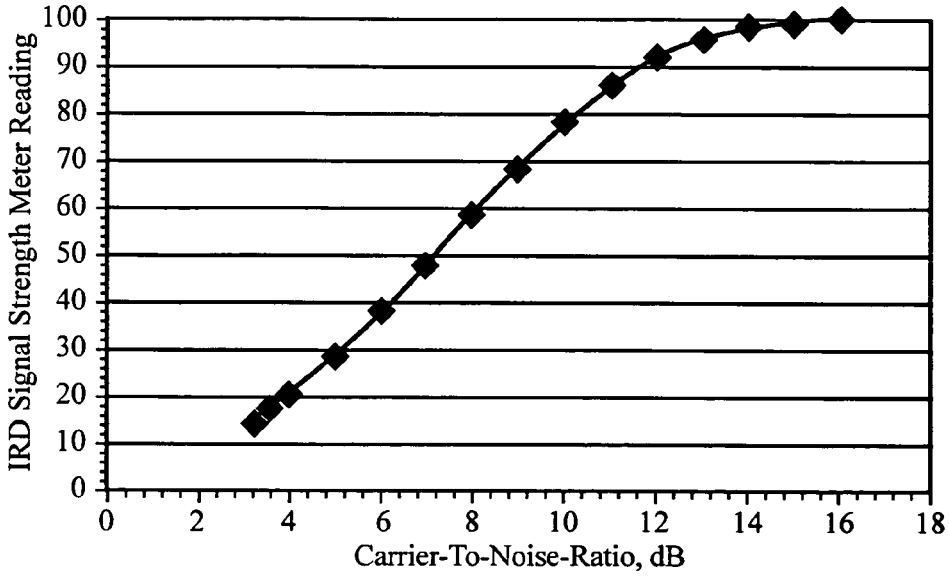
FIG. 1 is a plot of a current carrier-to-noise ratio versus IRD signal strength meter reading of a typical prior art IRD/outdoor unit combination.

In the following figures the same reference numerals will be used to illustrate the same components.

Figure 2:
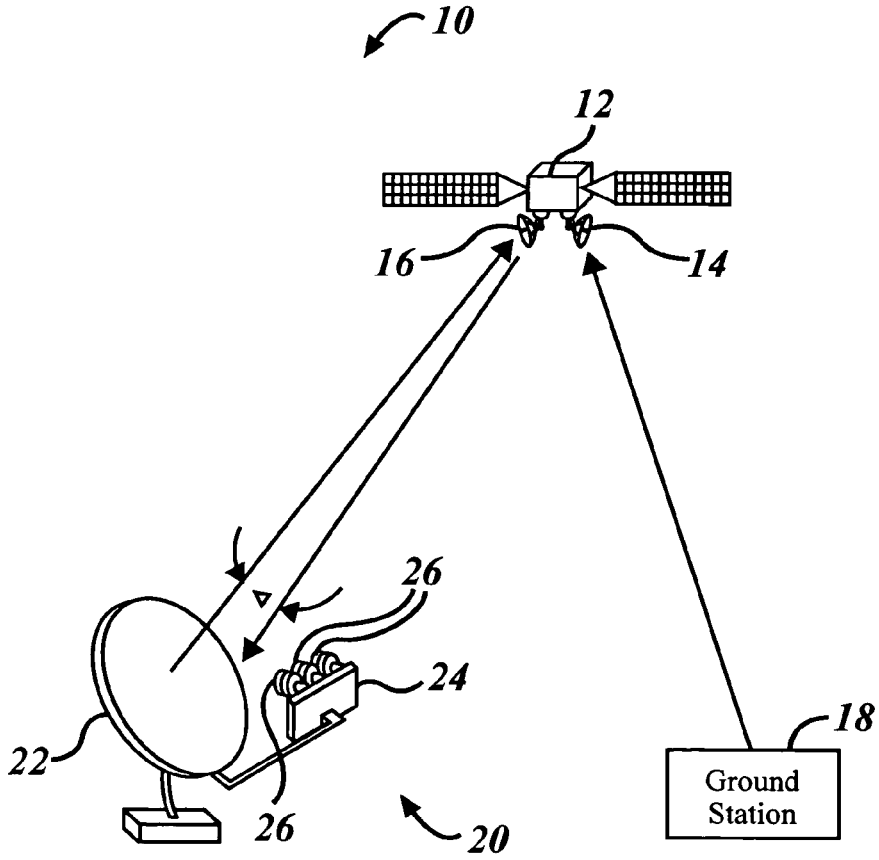
FIG. 2 is a high level elevational view of a satellite system according to the present invention.

Referring now to FIG. 2, a satellite system 10 is illustrated that includes a satellite 12 having a receiving antenna 14 and a transmitting antenna 16. The receiving antenna 14 receives signals from a ground station 18 such as television signals. The satellite 12 through transmitting antenna 16 transmits signals to an outdoor unit 20. The outdoor unit 20 includes an antenna dish 22 and a low noise block 24. A low noise block 24 may have a plurality of feed horns 26 thereon. As illustrated, three low noise blocks 26 are shown. However, various numbers of low noise blocks including a single low noise block may employ the present invention.

Figure 3:
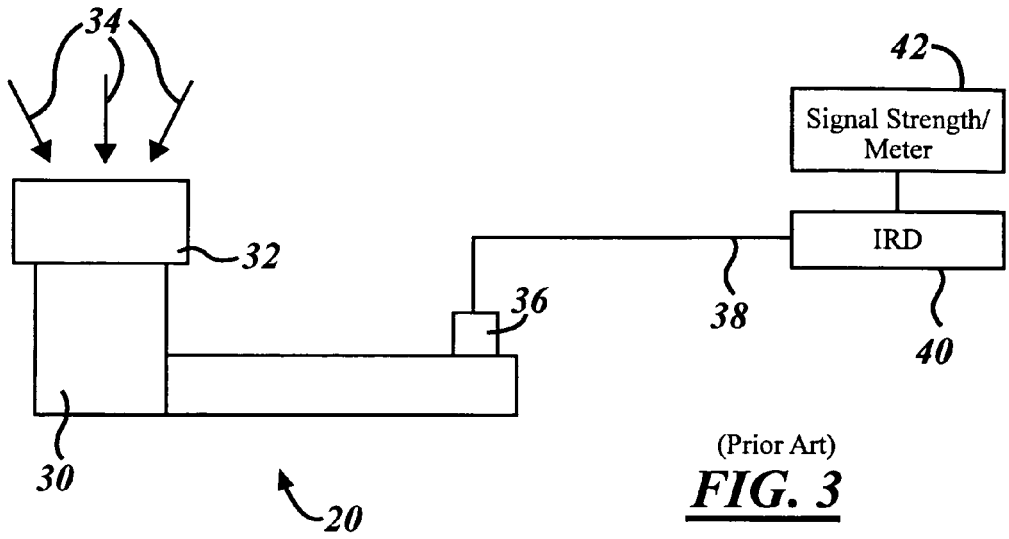
(Prior Art) FIG. 3
FIG. 3 is a side view of a low noise block.

Referring now to FIG. 3, a conventional low noise block 20 is illustrated. The low noise block includes a feed horn 30 having a plastic cover 32 thereon. The signal path 34 of satellite signals reflecting from the antenna dish 22 are illustrated with arrows 34. The feed horn 30 has an output connector 36 coupled thereto. Output connector 36 couples to a wire 38 and ultimately to an integrated receiver/decoder (IRD) 40 which is typically positioned within the dwelling or building. The IRD 40 may include integral therewith a signal strength meter 42. Of course, the signal strength meter 42 may be a separate device utilized by a service technician or system installer.

Figure 4:
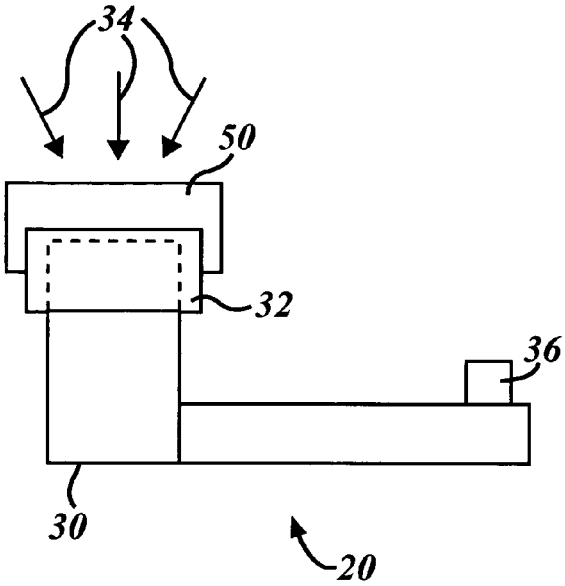
FIG. 4 is a side view of a low noise block having microwave absorbent material thereon.

Referring now to FIG. 4, a low noise block 20 is illustrated having feed horn 30 with a cover 32 thereon. The connector 36 may be coupled to an IRD 40 and meter 42 as in FIG. 3. A cap 50 disposed upon the cover 32 is utilized. The cap 50 has microwave-absorbing material thereon to absorb some of the microwave energy from the signals in the path 34. Preferably, the signals in the path are attenuated while not significantly disturbing the antenna pattern. The cap 50 may be used with or without cover 32. Without the cover 32 the cap 50 is coupled to feed horn 30. Preferably, cap 50 fits on snug but loose enough to be slidably removed. That is, the cap 50 is removable.

Referring now to FIG. 5, cap 50 has a base wall 52 and a side wall 54. In the present embodiment, the base wall 52 is generally circular in shape and thus the cap 50 is generally cylindrical in shape. Of course, the cap 50 may include multiple sides depending on the shape of the feed horn. The inside of the walls 54 are sized to receive the cap 32. The cap 32 preferably forms a snug fit with the cap 50. Of course, those skilled in the art will recognize that the cap 32 may be removed during testing while the cap 50 is used during testing. In this embodiment the cap 50 has microwave-absorbing material 56 on the exterior surface. As shown, the microwave-absorbing material 56 extends upon the exterior of the base wall 52. Also, the microwave-absorbing material may extend onto the exterior of the side wall 54. The microwave-absorbing material 56 may be a variety of materials such as a layer or a plurality of layers of suitable paint such as Millimeter Wave Technology Type MF-500 Microwave-absorbing Coating.

Referring now to FIG. 6, a cap 50' is illustrated having microwave-absorbing material disposed on the interior surface thereof. That is, the microwave coating 56 is disposed on the interior of the base wall 52. In addition, the microwave coating may also be disposed upon the interior of side wall 54.

Referring now to FIG. 7, a third embodiment of cap 50" is illustrated having a plug 60 therein. Plug 60 may be a preformed unit that is pressfit, integrally molded or otherwise disposed with the cap 50". The plug 60 is also formed of microwave-absorbing material. In this embodiment the plug 60 has a base wall 62 adjacent to the base wall 52 of cap 50". The absorbing plug also includes a side wall 64 disposed adjacent to the side wall 54 of the cap 50". In this manner, the plug 60 is generally cylindrical in shape to follow the general shape of the cap 50".

The common theme throughout FIGS. 5, 6 and 7 is that the microwave-absorbing material 56 is in the path of the satellite signals reflected from the antenna 22 of FIG. 2. The microwave-absorbing material 56 does not substantially alter the antenna pattern but provides enough attenuation so that signal meter readings may be obtained even in areas that have typically saturated meters.

Referring now to FIG. 8, various signal meter readings with the delta angle from boresight is illustrated. The delta angle from boresight is illustrated in FIG. 2 as angle Δ. As can be seen, the signal meter reading is lower with the cap illustrating signal attenuation. From comparing the Δ from boresight values from 1° left to 1° right for the case with no cap, the values for the same angular range measured with the microwave-absorbing cap on, it may be observed that when the cap is used, it is much easier to detect even a 1° change in the angular position. This will allow the installer to better provide accurate pointing of the antenna of the outdoor unit 20.

Figure 9:
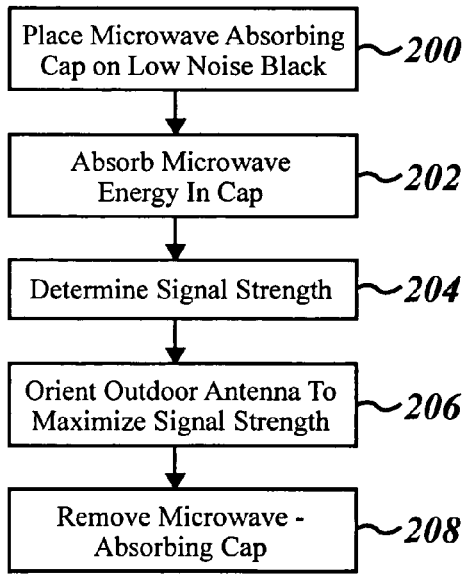
FIG. 9 is a flow chart illustrating the calibration technique according to the present invention.

Referring now to FIG. 9, a method of installing an outdoor unit includes placing a microwave-absorbing cap on a low noise block 200. As mentioned above, the cap may directly be coupled to the low noise block or placed upon a cover. In step 202, some of the microwave energy directed at the feed horn is absorbed by the cap. In step 204 the signal strength is determined with the microwave energy absorbing energy cap thereon. The signal strength may be determined by the meter within the IRD or using a separate meter. In step 206, the outdoor antenna is adjusted to maximize the signal strength received thereby. In step 208, the microwave-absorbing energy cap is removed so that the signal strength may be maximized during use. Should the antenna require repainting or readjustment in the future, the microwave-absorbing cap may be replaced upon the LNB to attenuate the signals into the LNB.

While particular embodiments of the invention have been shown and described, numerous variations and alternate embodiments will occur to those skilled in the art. Accordingly, it is intended that the invention be limited only in terms of the appended claims.

What is claimed is:

1. A method of aligning an outdoor antenna comprising:

placing a cap having a base wall and a side wall extending from and affixed to the base wall on a low noise block so that microwave-absorbing material on the base wall is positioned adjacent to a cover of the low noise block and the side wall positions the cap relative to the cover of the low noise block;

absorbing microwave energy with the microwave-absorbing material on the base wall of the cap;

thereafter, determining a signal strength; and orienting the outdoor antenna in a direction corresponding to a maximum signal strength.

2. A method as recited in claim 1 wherein the cap comprises a microwave-absorbing coating disposed on an exterior surface of the base wall.

3. A method as recited in claim 1 wherein the cap material comprises a microwave-absorbing coating disposed on an interior surface of the base wall.

4. A method as recited in claim 1 wherein the cap material comprises a microwave-absorbing plug disposed within the cap.

* * * * *